US008698020B2

(12) United States Patent
Kikuchi et al.

(10) Patent No.: US 8,698,020 B2
(45) Date of Patent: Apr. 15, 2014

(54) WIPER ATTACHMENT STRUCTURE AND WIPER ATTACHMENT METHOD

(75) Inventors: Shinji Kikuchi, Miyagi-Ken (JP); Hideki Abe, Miyagi-Ken (JP); Junichi Hosogoe, Miyagi-Ken (JP); Tsuguhisa Hayashida, Miyagi-Ken (JP)

(73) Assignee: Alps Electric Co., Ltd., Tokyo (JP)

( * ) Notice: Subject to any disclaimer, the term of this patent is extended or adjusted under 35 U.S.C. 154(b) by 608 days.

(21) Appl. No.: 13/026,130

(22) Filed: Feb. 11, 2011

(65) Prior Publication Data

US 2011/0219564 A1 Sep. 15, 2011

(30) Foreign Application Priority Data

Mar. 10, 2010 (JP) ..... 2010-053036

(51) Int. Cl.
*H01H 1/36* (2006.01)

(52) U.S. Cl.
USPC ..... 200/252; 200/241

(58) Field of Classification Search
USPC ..... 200/241, 242, 252, 253
See application file for complete search history.

(56) References Cited

U.S. PATENT DOCUMENTS 6,054,654 A * 4/2000 Ebata ..... 200/11 G
6,313,420 B1 * 11/2001 Ohashi ..... 200/302.1

FOREIGN PATENT DOCUMENTS

JP 5-41102 6/1993

* cited by examiner

*Primary Examiner* — Renee Luebke
*Assistant Examiner* — Lheiren Mae Caroc
(74) *Attorney, Agent, or Firm* — Beyer Law Group LLP

(57) ABSTRACT

A wiper holder to which a wiper is attached has an attachment surface including a positioning boss configured to position the wiper by being passed through a positioning hole in the wiper, a positioning protrusion configured to position a first edge of the wiper, and a swage boss configured to receive a second edge of the wiper. The first edge of the wiper contacts the positioning protrusion to position the first edge of the wiper and the wiper is secured to the wiper holder by the swage boss being swaged while the positioning boss is passed through the positioning hole in the wiper and the second edge of the wiper being received by the swage boss.

10 Claims, 9 Drawing Sheets

WIPER ATTACHMENT STRUCTURE AND WIPER ATTACHMENT METHOD

CLAIM OF PRIORITY

This application claims benefit of Japanese Patent Application No. 2010-053036 filed on Mar. 10, 2010, which is hereby incorporated by reference.

BACKGROUND OF THE INVENTION

1. Field of the Invention

The present invention relates to a wiper attachment structure and a wiper attachment method that can be applied to various sensors using variable resistors.

2. Description of the Related Art

Variable resistors used in various sensors typically have a substrate on which various patterns, such as a resistor pattern, are applied and are constituted of an electrically-insulated wiper holder securely holding a wiper that includes a metal wiper piece resiliently contacting the patterns. For example, in the case of a rotary sensor, various types of electrical detection, such as detecting a change in resistance, can be performed by sliding a wiper (a wiper piece of the wiper) on the pattern as a wiper holder rotates.

With such variable resistors, various different structures to attach a wiper to a wiper holder have been proposed. For example, in Japanese Unexamined Utility Model Registration Application Publication No. 5-41102, a protrusion provide on a wiper holder is passed through a hole in the wiper, and then the tip of the protrusion is swaged to secure the wiper to the wiper holder.

SUMMARY OF THE INVENTION

The attachment structure disclosed in Japanese Unexamined Utility Model Registration Application Publication No. 5-41102 prevents looseness of a wiper secured on a wiper holder by forming a hole having a specific shape in the wiper. However, as the same as in other known attachment structures, a protrusion on the wiper holder is passed through a hole in the wiper and is swaged. Therefore, even if looseness is prevented, the tip of the wiper (the tip of the wiper piece contacting the pattern) may not be precisely positioned depending on the clearance between the hole and the protrusion and/or the swaging condition. Accordingly, only swaging of a protrusion passed through a hole is accomplished, and the positioning precision of the tip of the wiper is limited.

The present invention has been conceived in light of the circumstances described above and provides a wiper attachment structure and a wiper attachment method that improves the positioning precision of the tip of a wiper.

The present invention provides a wiper attachment structure configured to secure a wiper to a wiper holder, including a positioning boss configured to position the wiper by being passed through a positioning hole in the wiper; a positioning protrusion configured to position a first edge of the wiper; and a swage boss configured to receive a second edge of the wiper, wherein the positioning boss, the positioning protrusion, and the swage boss are disposed on an attachment surface of the wiper holder to which the wiper is attached, and wherein the first edge of the wiper contacts the positioning protrusion to position the first edge of the wiper and the wiper is secured to the wiper holder by the swage boss being swaged while the positioning boss is passed through the positioning hole in the wiper and the second edge of the wiper being received by the swage boss.

With the wiper attachment structure described above, the wiper positioned by the positioning boss contacts the positioning protrusion (having a positioning reference surface) by swaging the swage boss, and as a result the first edge is positioned. Since the first edge of the wiper is positioned by the swaging and the resulting positioning and contacting, compared with a known attachment structure using only swaging, the positioning precision of the first edge of the wiper (or the tip of the wiper, which is the point of load (when the tips of the wiper pieces of the wiper contacts a resistor pattern)) can be improved significantly. This structure is also effective when the attachment space is limited.

In the wiper attachment structure described above, it is desirable that a fulcrum boss configured to be passed through an engagement hole in the wiper and provided on the attachment surface of the wiper holder be further included and the first edge of the wiper contact the positioning protrusion by turning the wiper toward the positioning protrusion around the fulcrum boss as result of swaging the swage boss. In this case, since the movement of the wiper toward the positioning protrusion due to swaging the swage boss can be restricted (controlled) by the fulcrum boss, the positioning precision of the first edge of the wiper (or the tip of the wiper) can be improved even more.

It is desirable that, in the wiper attachment structure described above, a tapered pressure-receiving surface receiving swaging pressure from the swage boss be provided on the second edge of the wiper received by the swage boss and the pressure-receiving surface be tapered to generate a directional component of the swaging pressure in a direction toward the positioning protrusion. In this case, the tapered pressure-receiving surface of the wiper can reliably guide the wiper toward the positioning protrusion (by swaging the swage boss). Since the pressure-receiving area is increased by the tapered pressure-receiving surface, a large swaging force can be efficiently applied toward the positioning protrusion to perform efficient swaging, and thus, highly precise positioning of the first edge of the wiper (or the tip of the wiper) can be carried out.

It is desirable that, in the wiper attachment structure described above, a tapered pressure-receiving surface receiving swaging pressure from the swage boss be provided on the swage boss and the pressure-receiving surface be tapered to generate a directional component of the swaging pressure in a direction toward the positioning protrusion. In this case, the swaged part of the swage boss can be reliably pushed out toward the positioning protrusion by the tapered pressure-receiving surface of the swage boss. Since the pressure-receiving area is increased by the tapered pressure-receiving surface, a large swaging force can be efficiently transferred to the wiper in the direction of the positioning protrusion to perform efficient swaging, and thus, highly precise positioning of the first edge of the wiper (or the tip of the wiper) can be carried out.

The present invention provides a method of securing a wiper to a wiper holder, the wiper holder to which the wiper is attached having an attachment surface including a positioning boss configured to position the wiper by being passed through a positioning hole in the wiper, a positioning protrusion configured to position a first edge of the wiper, and a swage boss configured to receive a second edge of the wiper, the method including the step of swaging the swage boss while the positioning boss is passed through the positioning hole in the wiper and the second edge of the wiper is received by the swage boss so as to position the first edge of the wiper by contacting the first edge of the wiper to the positioning protrusion and secure the wiper to the wiper holder.

With the method of securing a wiper described above, the wiper positioned by the positioning boss contacts the positioning protrusion (having a positioning reference surface) by swaging the swage boss, and as a result the first edge is positioned. Since the first edge of the wiper is positioned by the swaging and the resulting positioning and contacting, compared with a known attachment structure using only swaging, the positioning precision of the first edge of the wiper (or the tip of the wiper, which is the point of load (when the tips of the wiper pieces of the wiper contacts a resistor pattern)) can be improved significantly.

In the method of securing a wiper described above, it is desirable that the swaging of the swage boss be carried out such that a swaged part of the swage boss is pushed out toward the positioning protrusion. In this case, since the movement of the wiper toward the positioning protrusion by swaging the swage boss reliably occurs, the positioning precision of the first edge of the wiper (or the tip of the wiper) can be improved even more.

It is desirable that the method of securing a wiper described above further include the step of pushing an acting surface of a tool configured to swage the swage boss against the swage boss in the vertical direction to generate a directional component of swaging pressure in a direction toward the positioning protrusion so as to push out the swaged part of the swage boss toward the positioning protrusion. In this case, the vertical movement of the tool can be reliably converted to movement of the wiper toward the positioning protrusion.

In the method of securing a wiper described above, it is desirable that the acting surface be tapered. In this case, the tapered acting surface can reliably convert the vertical force of the tool to movement of the wiper toward the positioning protrusion.

In the method of securing a wiper described above, it is desirable that the acting surface have a first restricting part restricting the flow of the swaged part of the swage boss in the pushed direction and a second restricting part restricting the flow of the swaged part of the swage boss in the direction opposite to the pushed direction. In this case, the first and second restricting parts push out the swaged part of the swage boss efficiently and without loss toward the positioning protrusion, and, thus, the positioning precision of the first edge of the wiper (or the tip of the wiper) can be significantly improved.

In the method of securing a wiper described above, it is desirable that a tapered pressure-receiving surface configured to receive swaging pressure from the swage boss be provided on the second edge of the wiper received by the swage boss and the pressure-receiving surface be tapered to generate a directional component of the swaging pressure in a direction toward the positioning protrusion. In this case, the tapered pressure-receiving surface of the wiper can reliably guide the wiper toward the positioning protrusion (by swaging the swage boss). Since the pressure-receiving area is increased by the tapered pressure-receiving surface, a large swaging force can be efficiently applied toward the positioning protrusion to perform efficient swaging, and thus, highly precise positioning of the first edge of the wiper (or the tip of the wiper) can be carried out.

In the method of securing a wiper described above, it is desirable that a tapered pressure-receiving surface configured to receive swaging pressure from the acting surface of the tool be provided on the swage boss and the pressure-receiving surface be tapered to generate a directional component of the swaging pressure in a direction toward the positioning protrusion. In this case, the swaged part of the swage boss can be reliably pushed out toward the positioning protrusion by the tapered pressure-receiving surface of the swage boss. Since the pressure-receiving area is increased by the tapered pressure-receiving surface, a large swaging force can be efficiently transferred to the wiper in the direction of the positioning protrusion to perform efficient swaging, and thus, highly precise positioning of the first edge of the wiper (or the tip of the wiper) can be carried out.

DESCRIPTION OF THE PREFERRED EMBODIMENTS

Figure 1:
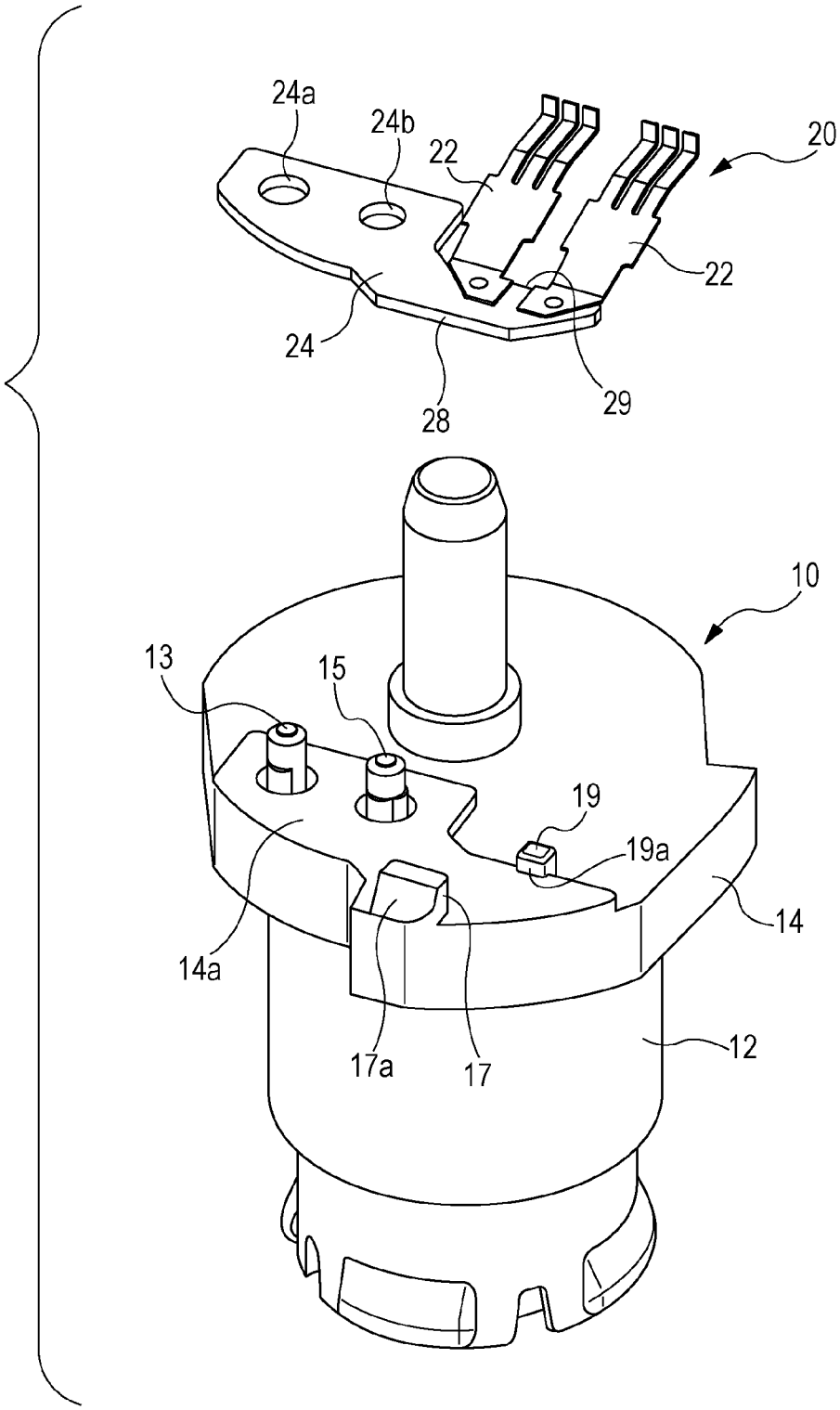
FIG. 1 is an exploded perspective view of a wiper attachment structure according to an embodiment of the present invention before attachment.
Figure 2:
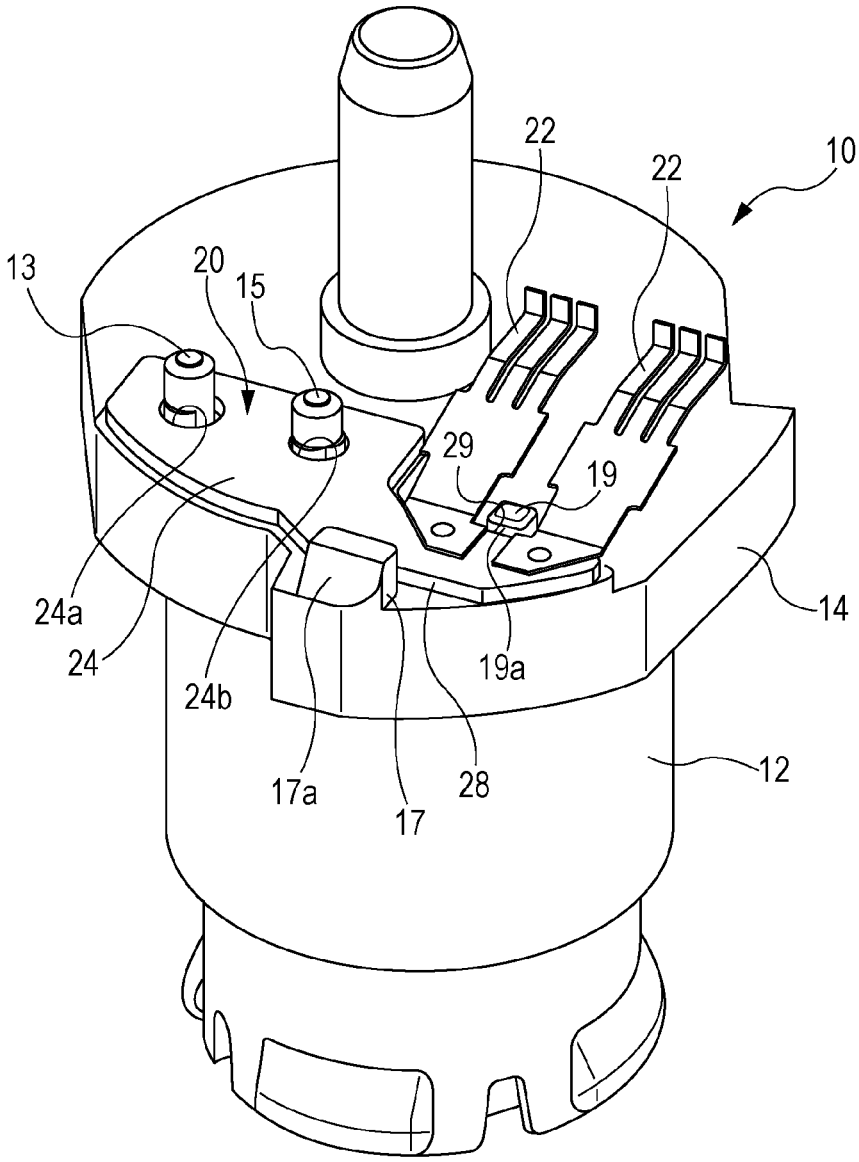
FIG. 2 is a perspective view of the wiper attachment structure according to this embodiment after attachment.
Figure 3:
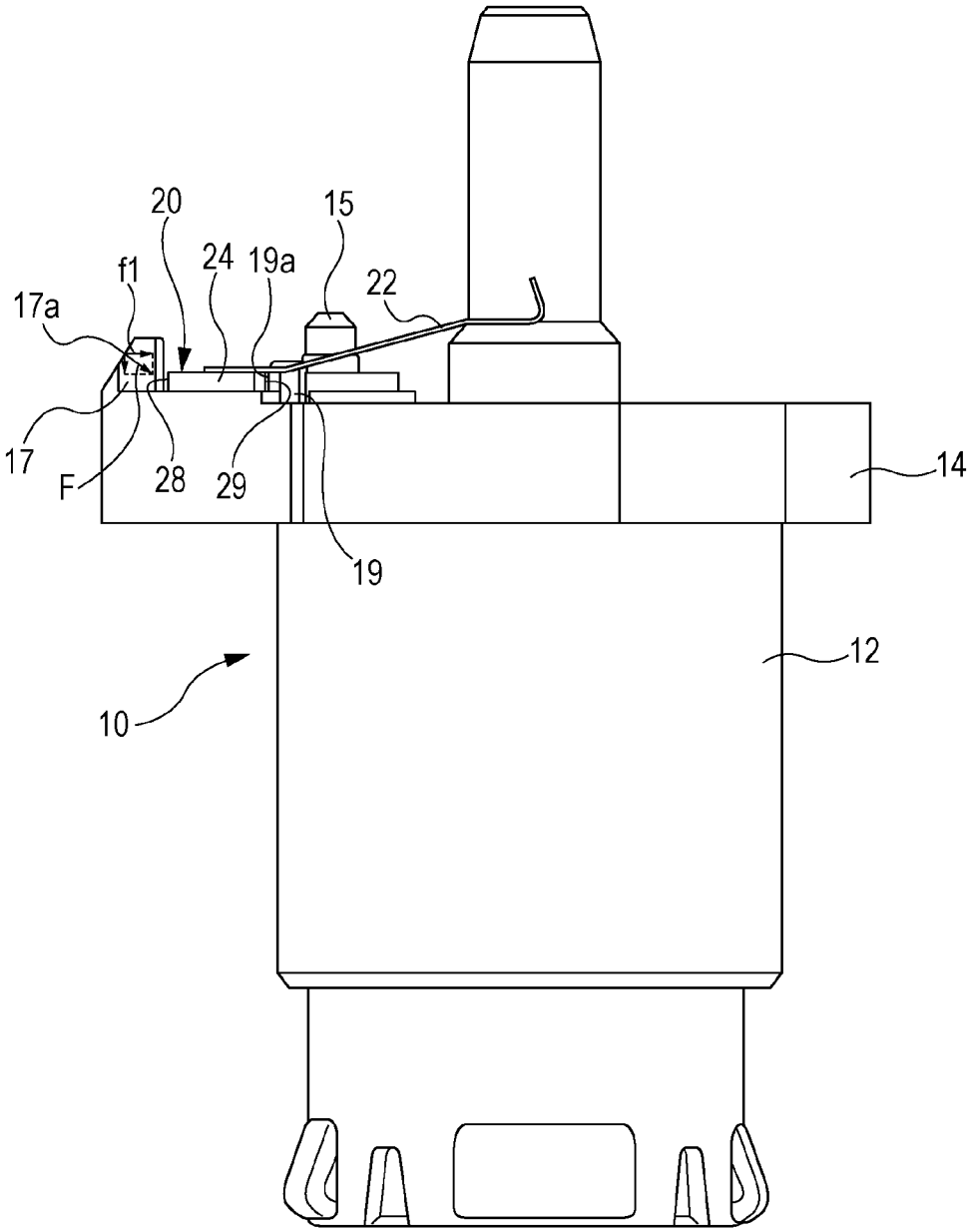
FIG. 3 is a side view of the wiper attachment structure according to this embodiment after attachment.
Figure 4:
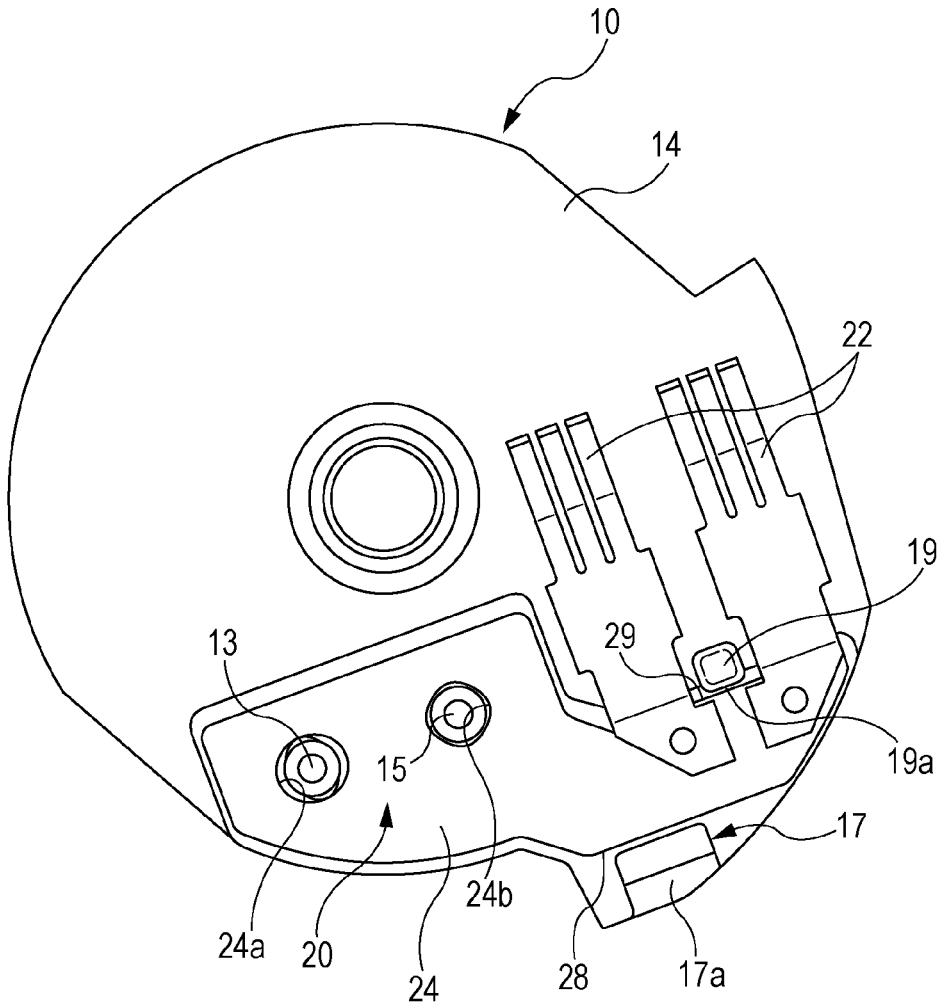
FIG. 4 is a plan view of the wiper attachment structure according to this embodiment after attachment.
Figure 5:
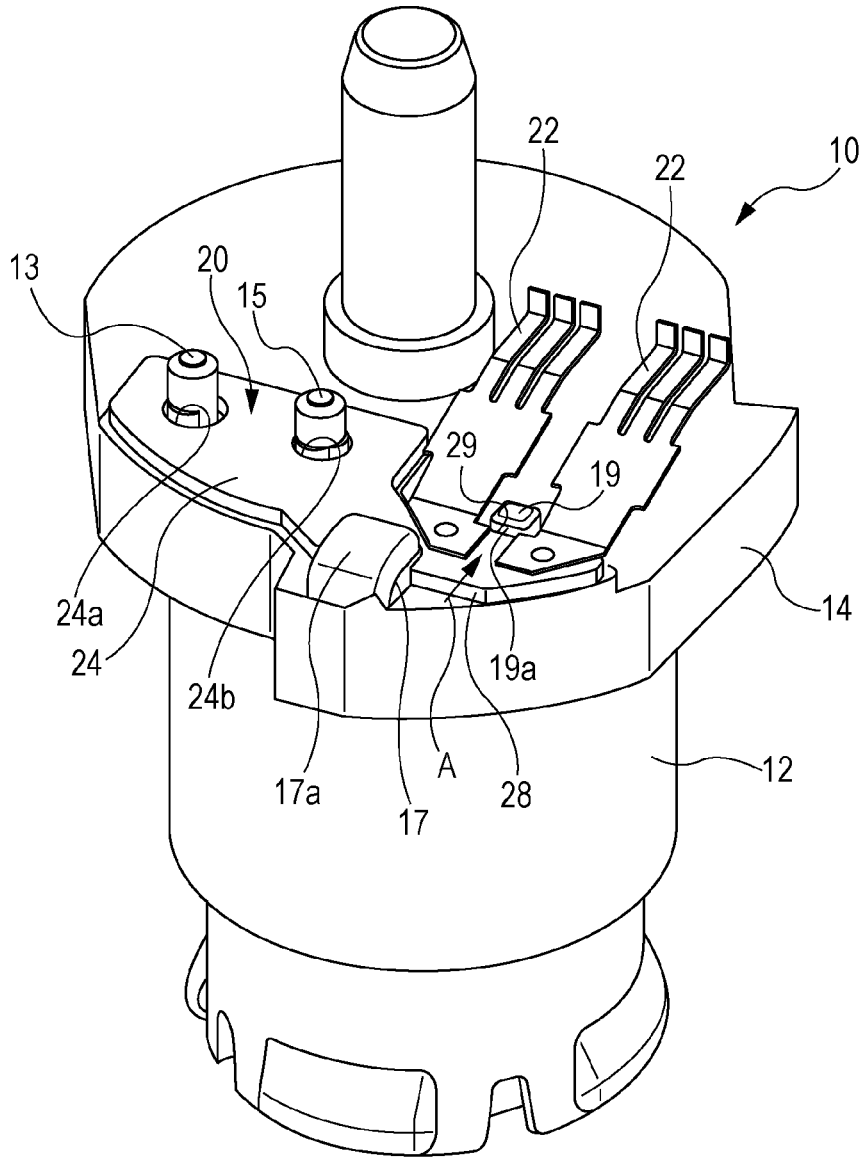
FIG. 5 is a perspective view of the wiper attachment structure according to this embodiment after swaging.
Figure 6:
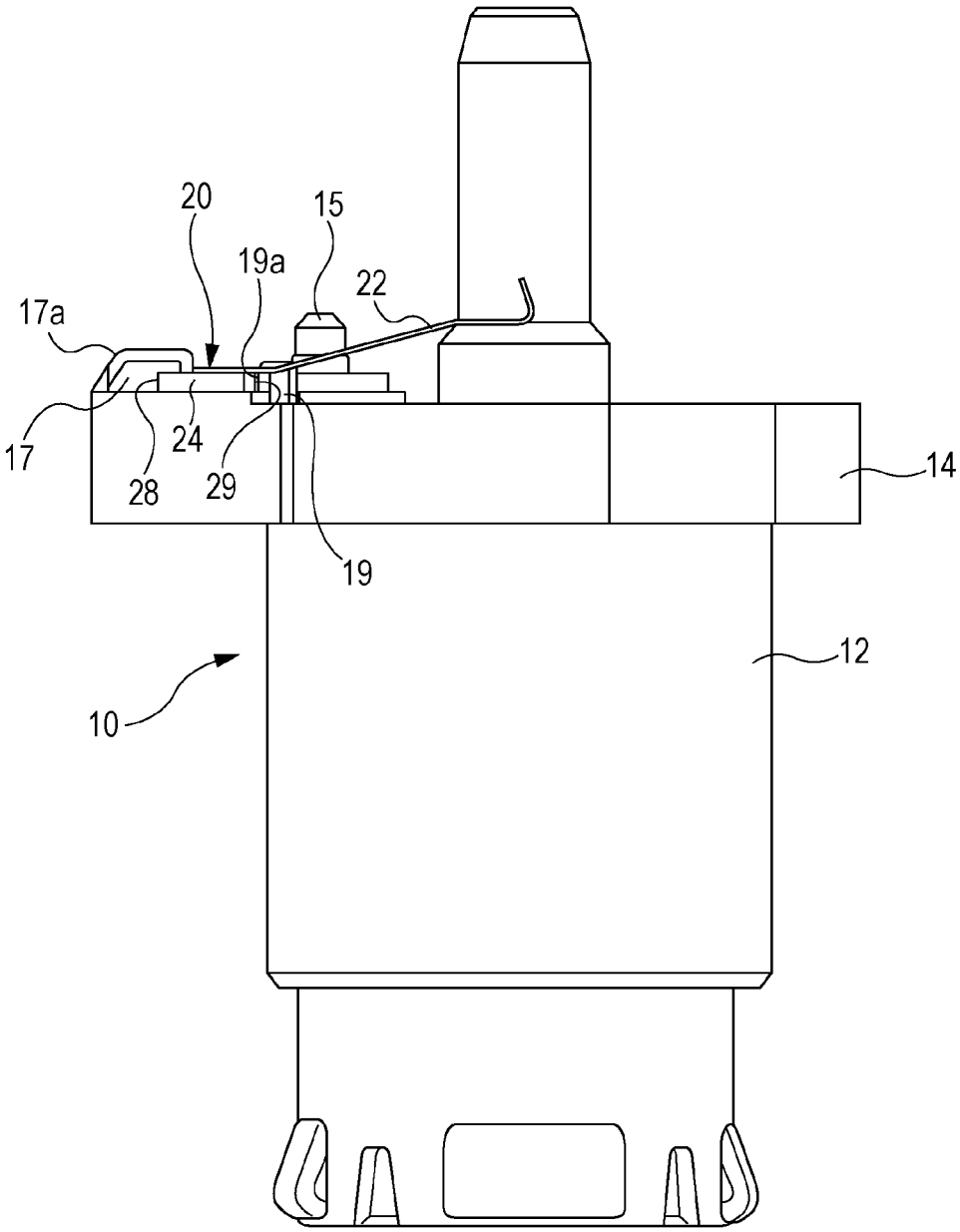
FIG. 6 is a side view of the wiper attachment structure according to this embodiment after swaging.
Figure 7:
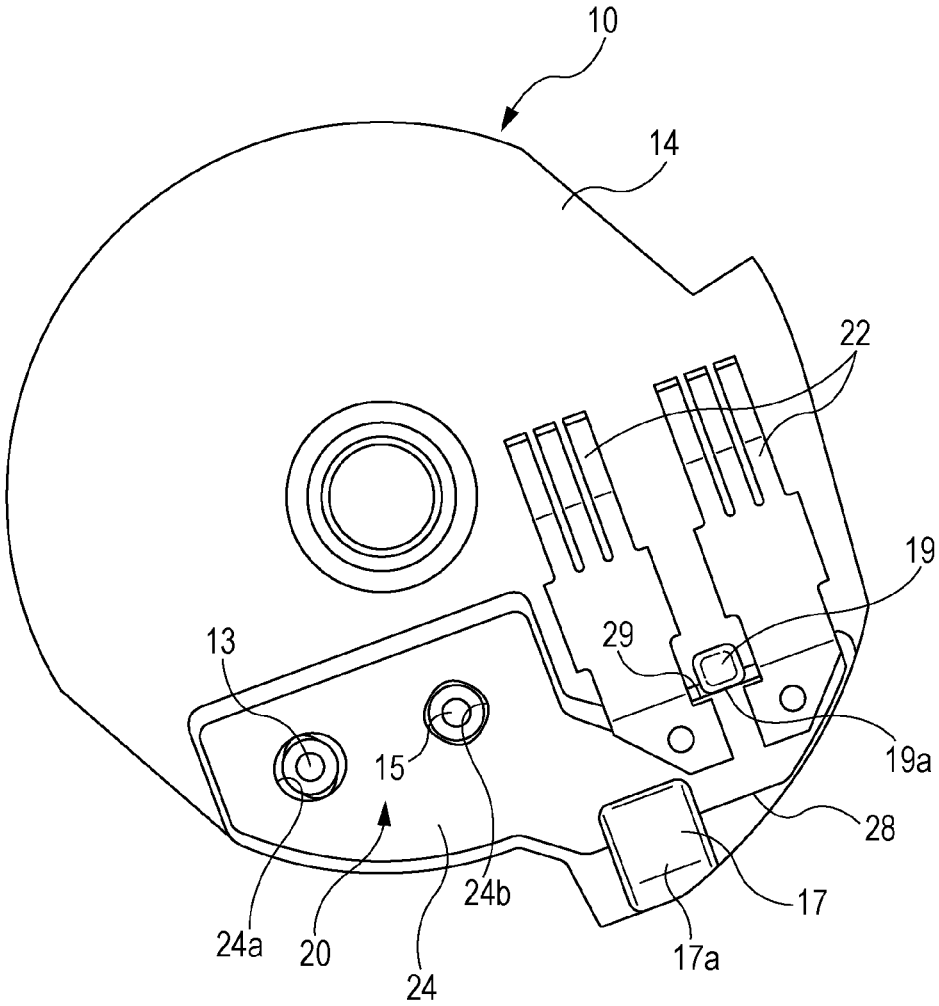
FIG. 7 is a plan view of the wiper attachment structure according to this embodiment after swaging.

The present invention will be described in detail below with reference to the accompanying drawings. FIG. 1 is an exploded perspective view of a wiper attachment structure according to an embodiment of the present invention before attachment. FIGS. 2, 3, and 4 are, respectively, a perspective view, a side view, and a plan view of the wiper attachment structure according to this embodiment after attachment. FIGS. 5, 6, and 7 are, respectively, a perspective view, a side view, and a plan view of the wiper attachment structure according to this embodiment after swaging.

A wiper attachment structure according to an embodiment of the present invention for a variable resistor used in, for example, a rotation-angle detecting sensor of a swirl control valve that swirls or tumbles air by opening and closing a valve sending a mixture of gasoline and air to a cylinder at the in-take of an engine will be described below. The wiper attachment structure according to the present invention is not limited to such an application and may be applied in various ways.

The variable resistor used in the above-described rotation-angle detecting sensor has a substrate (not shown) on which a resistor pattern is applied and is constituted of a wiper holder 14 securely holding a wiper 20 that includes metal wiper pieces 22 resiliently contacting the resistor pattern, as illustrated in FIGS. 1 and 2. The wiper holder 14 is disposed at an end of a cylindrical barrel 12 of a rotating rotor 10.

As illustrated in FIGS. 1 and 2, an attachment surface 14*a* of the wiper holder 14 to which the wiper 20 is attached has a positioning boss 13 that positions the wiper 20 by being passed through a positioning hole 24*a* in the main body 24 of the wiper 20, a positioning protrusion 19 that positions a first edge 29 of the main body 24 of the wiper 20, and a swage boss 17 that receives a second edge 28 of the main body 24 of the wiper 20. The attachment surface 14*a* of the wiper holder 14 may also have a fulcrum boss 15 that is passed through an engagement hole 24*b* in the main body 24 of the wiper 20. The metal wiper pieces 22 that resiliently contact the resistor pattern are attached to the main body 24 of the wiper 20.

The bosses 13, 15, and 17 are made of resin and are relatively positioned such that the wiper 20 can turn around the fulcrum boss 15 when the swage boss 17 is swaged while the second edge 28 of the wiper 20 is received by the swage boss 17 (the state illustrated in FIGS. 2 to 4). Specifically, in this embodiment, the swage boss 17 and the positioning boss 13 are disposed on opposite sides of the fulcrum boss 15 (i.e., the swage boss 17 and the positioning boss 13 are disposed on both sides of the fulcrum boss 15). The positioning boss 13 and the fulcrum boss 15 are respectively engaged with the holes 24*a* and 24*b* of the wiper 20 with a predetermined about of backlash (see FIG. 4) so as to allow turning of the wiper 20 around the fulcrum boss 15 when swaging the swage boss 17 while the second edge 28 of the wiper 20 is engaged with the swage boss 17 as described below (the state illustrated in FIGS. 2 to 4).

As illustrated in FIG. 3, the swage boss 17 may have a tapered pressure-receiving surface 17*a* that receives the swaging pressure F. The pressure-receiving surface 17*a* is tapered such that a directional component f1 of the swaging pressure F is generated in the direction toward the positioning protrusion 19. Specifically, the pressure-receiving surface 17*a* is tapered such that the back surface of the swage boss 17 facing the direction away from the positioning protrusion 19 rises rightward.

With the configuration described above, to secure the wiper 20 to the wiper holder 14, first, in the disassembled state illustrated in FIG. 1, the positioning boss 13 is passed through the positioning hole 24*a* in the wiper 20 and the fulcrum boss 15 is passed through the engagement hole 24*b* of the wiper 20 such that the second edge 28 of the wiper 20 comes into contact with the swage boss 17 (see FIGS. 2 to 4). Then, by swaging the swage boss 17, the first edge 29 of the wiper 20 is positioned by contacting the first edge 29 of the wiper 20 to a positioning reference surface 19*a* of the positioning protrusion 19 and securing the wiper 20 to the wiper holder 14 (see FIGS. 5 to 7).

As represented by Arrow A in FIG. 5, when the swage boss 17 is swaged, the swaged part of the swage boss 17 may be pushed toward the positioning protrusion 19. In this way, the wiper 20 turns around the fulcrum boss 15 toward the positioning protrusion 19, causing the first edge 29 to contact the positioning protrusion 19 and to precisely position the wiper pieces 22 of the wiper 20 with respect to the resistor pattern. At the same time or after securing, the other bosses 13 and 15 may be swaged to ensure the positioning and securing. The swaged boss 17 also prevents the tip of the wiper 20, i.e., the point of load when pressure is applied to the wiper pieces 22, from lifting.

Figure 8A:
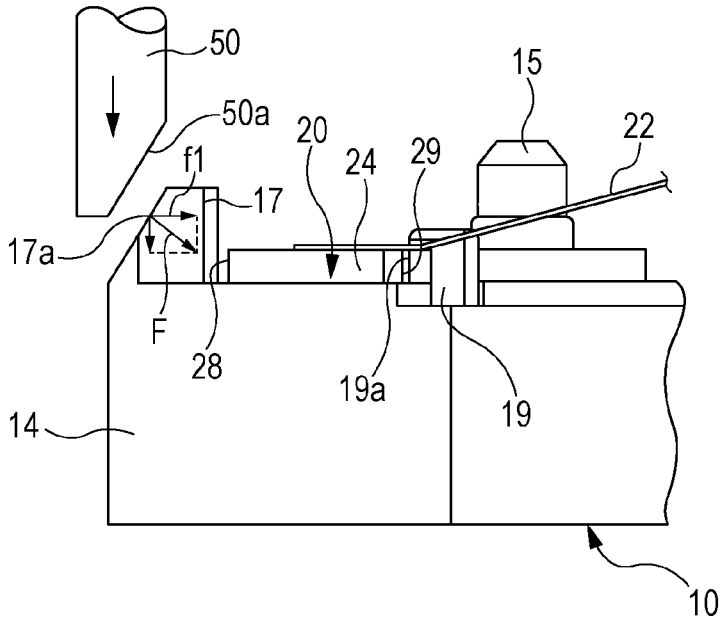
FIGS. 8A and 8B are side views of a tool used in the wiper attachment structure according to this embodiment.

As illustrated in FIG. 8A, the swaging (heat swaging) of the swage boss 17 described above may be carried out by pushing an acting surface 50*a* of a swaging punch (tool) 50 against the tapered pressure-receiving surface 17*a* of the swage boss 17 in the vertical direction. In this case, it is desirable that the acting surface 50*a* be tapered as illustrated in the drawing (tilted in the same direction as the pressure-receiving surface 17*a*) to efficiently push out the swaged part (melted resin) of the swage boss 17 toward the positioning protrusion 19 by effectively generating the directional component f1 of the swaging pressure in the direction of the positioning protrusion 19.

As described above, according to this embodiment, the wiper 20 positioned by the positioning boss 13 contacts the positioning protrusion 19 by swaging the swage boss 17, and as a result the first edge 29 is positioned. Since the first edge 29 of the wiper 20 is positioned by the swaging and the resulting positioning and contacting, compared with a known attachment structure employing only swaging, the positioning precision of the first edge 29 of the wiper 20 (and as a result the tip of the wiper 20 (the tips of the wiper pieces 22 of the wiper 20), which is the point of load) can be improved significantly. Particularly, according to this embodiment, since the bosses 13 and 15 and the holes 24*a* and 25*b* are respectively engaged with backlash (looseness) and the backlash is removed by turning (moving) the components during assembly, the efficiency and easiness of assembly can be improved. This structure is also effective when the attachment space is limited.

Figure 8B:
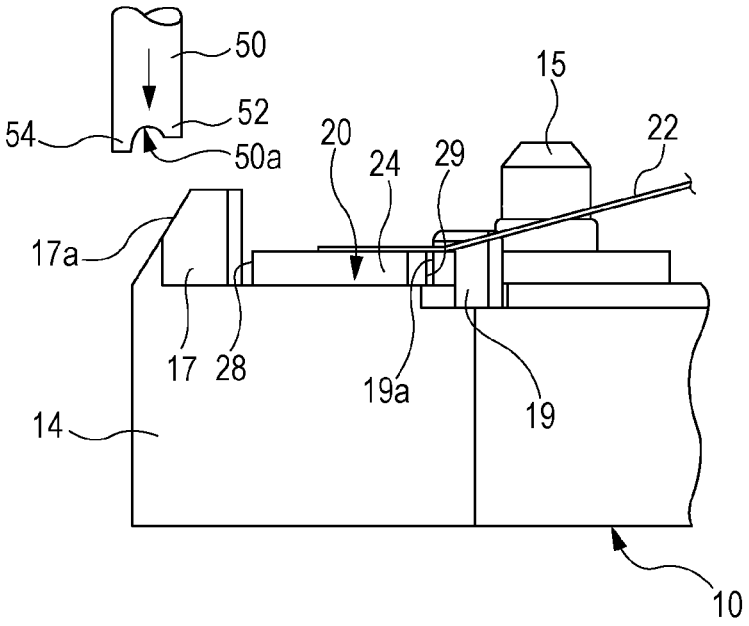

FIG. 8B illustrates another acting surface 50*a* of the swaging punch 50 that swages the swage boss 17. As illustrated in the drawing, the acting surface 50*a* may have a first restricting part 52 that restricts the flow of the swaged part of the swage boss 17 in the pushed direction and a second restricting part 54 that restricts the flow of the swaged part of the swage boss 17 in the direction opposite to the pushed direction. In this case, the first restricting part 52 is a protrusion protruding downward, and the second restricting part 54 is a protrusion protruding further downward than the first restricting part 52. An arc-shaped depression is provided between the first restricting part 52 and the second restricting part 54.

In this case, the restricting parts 52 and 54 push out the swaged part of the swage boss 17 efficiently and without loss toward the positioning protrusion 19, and, thus, the positioning precision of the first edge 29 of the wiper 20 can be significantly improved.

Figure 9:
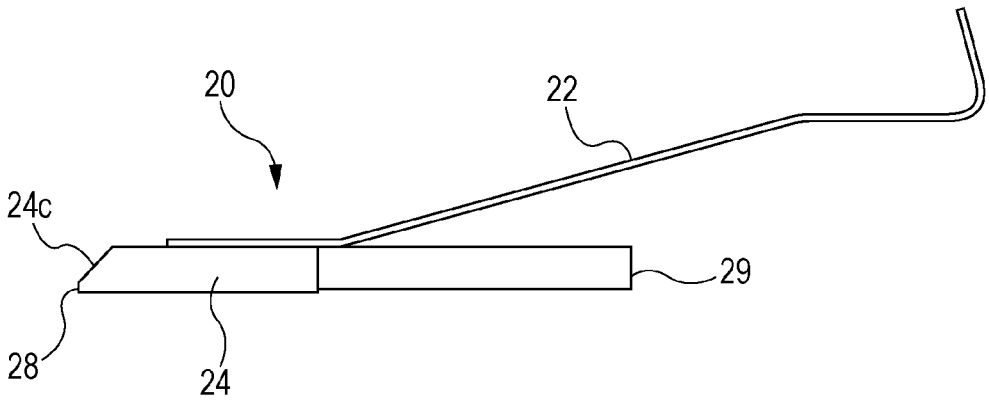
FIG. 9 is a side view of the wiper according to a variation of the above-described embodiment.

FIG. 9 is a side view of the wiper 20 according to a variation of the above-described embodiment. As illustrated in FIG. 9, the second edge 28 of the wiper 20 received by the swage boss 17 may have a tapered pressure-receiving surface 24*c* that receives the swaging pressured from the swage boss 17. The pressure-receiving surface 24*c* is tapered such that the directional component f1 of the swaging pressure is generated in the direction toward the positioning protrusion 19.

The tapered pressure-receiving surface 24*c* of the wiper 20 according to this variation can reliably guide the wiper 20 toward the positioning protrusion 19 (by swaging the swage boss 17). Since the pressure-receiving area is increased by the tapered pressure-receiving surface 24*c*, a large swaging force can be efficiently applied to the positioning protrusion 19 to perform efficient swaging, and thus, highly precise positioning of the first edge 29 of the wiper 20 can be carried out.

The present invention is not limited to the embodiments described above, and various modifications are possible. The embodiments described above are not limited the sizes and shapes illustrated in the accompanying drawings and may be appropriately modified without deviating from the scope of the invention. Other modifications are also possible without deviating from the scope of the invention.

What is claimed is:

1. A wiper attachment structure configured to secure a wiper to a wiper holder, comprising:

a positioning boss configured to position the wiper by being passed through a positioning hole in the wiper;

a positioning protrusion configured to position a first edge of the wiper; and a swage boss configured to receive a second edge of the wiper, wherein the positioning boss, the positioning protrusion, and the swage boss are disposed on an attachment surface of the wiper holder to which the wiper is attached, and wherein the swage boss is swaged such that a swaged part of the swage boss is pushed out toward the positioning protrusion while the positioning boss is passed through the positioning hole in the wiper and the second edge of the wiper is received by the swage boss, whereby the first edge of the wiper is positioned by contacting the positioning protrusion and the wiper is secured to the wiper holder.

2. The wiper attachment structure according to claim 1, further comprising:

a fulcrum boss provided on the attachment surface of the wiper holder, the fulcrum boss being configured to be passed through an engagement hole in the wiper, wherein the first edge of the wiper contacts the positioning protrusion by turning the wiper toward the positioning protrusion around the fulcrum boss as result of swaging the swage boss.

3. The wiper attachment structure according to claim 1, wherein the second edge of the wiper includes:

a tapered pressure-receiving surface configured to receive a swaging pressure from the swage boss, the tapered pressure-receiving surface generating a directional component of the swaging pressure in a direction toward the positioning protrusion.

4. The wiper attachment structure according to claim 1, wherein the swage boss includes:

a tapered pressure-receiving surface configured to receive a swaging pressure, the tapered pressure-receiving surface generating a directional component of the swaging pressure in a direction toward the positioning protrusion.

5. A method of securing a wiper to a wiper holder, the wiper holder including:

an attachment surface; and a positioning boss configured to position the wiper by being passed through a positioning hole in the wiper, a positioning protrusion configured to position a first edge of the wiper, and a swage boss configured to receive a second edge of the wiper, the positioning boss, the positioning protrusion, and the swage boss being provided on the attachment surface, the method comprising:

providing the wiper on the attachment surface such that the positioning boss is passed through the positioning hole and the second edge of the wiper is received by the swage boss; and swaging the swage boss such that a swaged part of the swage boss is pushed out toward the positioning protrusion, whereby the first edge of the wiper is positioned by contacting the positioning protrusion and the wiper is secured to the wiper holder.

6. The method of securing a wiper according to claim 5, further comprising:

pushing an acting surface of a swaging tool against the swage boss in a vertical direction and generating a directional component of a swaging pressure in a direction toward the positioning protrusion so as to push out the swaged part of the swage boss toward the positioning protrusion.

7. The method of securing a wiper according to claim 6, wherein the acting surface is tapered.

8. The method of securing a wiper according to claim 6, wherein the acting surface of the swaging tool has a first restricting part and a second restricting part, the method further comprising:

restricting a flow of the swaged part of the swage boss in a pushed direction by the first restricting part; and restricting a flow of the swaged part of the swage boss in a direction opposite to the pushed direction by the second restricting part.

9. The method of securing a wiper according to claim 6, further comprising:

applying a swaging pressure from the swage boss to a tapered pressure-receiving surface provided on the second edge of the wiper, the tapered pressure-receiving surface generating a directional component of the swaging pressure in a direction toward the positioning protrusion.

10. The method of securing a wiper according to claim 6, further comprising:

applying a swaging pressure from the acting surface of the tool to a tapered pressure-receiving surface provided on the swage boss, the tapered pressure-receiving surface generating a directional component of the swaging pressure in a direction toward the positioning protrusion.

* * * * *